United States Patent [19]

Beck

[11] 4,287,986

[45] Sep. 8, 1981

[54] EARRING DISPLAY CASE

[76] Inventor: William M. Beck, 133 Barbara Dr., Edmond, Okla. 73034

[21] Appl. No.: 75,517

[22] Filed: Sep. 13, 1979

[51] Int. Cl.[3] ..... B65D 5/50

[52] U.S. Cl. ..... 206/45.19; 206/45.23; 206/45.24; 206/472; 206/566; 229/33; 229/36

[58] Field of Search ..... 206/45.14, 45.17, 45.23, 206/45.21, 566, 45.19, 472–475, 45.24; 229/33, 36

[56] References Cited

U.S. PATENT DOCUMENTS

| | | | |
|---|---|---|---|
| 468,224 | 2/1892 | Kennedy, Jr. | 206/473 |
| 2,112,062 | 3/1938 | Berger | 206/45.14 |
| 2,192,473 | 3/1942 | Huston | 206/472 |
| 2,234,402 | 3/1941 | Frankenstein | 229/33 |
| 2,739,697 | 3/1956 | Kuddes | 206/566 |

FOREIGN PATENT DOCUMENTS

| | | | |
|---|---|---|---|
| 730998 | 3/1966 | Canada | 206/474 |

*Primary Examiner*—Joseph Man-Fu Moy
*Attorney, Agent, or Firm*—William R. Laney

[57] ABSTRACT

An earring and pendant display case which includes a substantially rectangular back hinge panel having opposed, parallel side edges and opposed, parallel end edges; a pair of opposed, substantially rectangular display panels each having a side hingedly connected to one of the side edges of said back hinge panel, and each further having a second side edge and opposed, parallel end edges terminating in alignment with the end edges of said back hinge panel; and a pair of end hinge panels each including a first side edge and each having a second side edge, said end hinge panels being hingedly connected along the second side edges thereof to opposed end edges of each of said display panels. Four flexible cover flaps each have an edge connected to the first side edge of one of the end hinge panels; and a pair of locking panels are hingedly connected to the second side edges of the two display panels, and overlap each other when the display panels are folded upon said back hinge panel to positions in which they extend parallel to each other. A plurality of substantially parallel, spaced clip bars extend transversely across each of the display panels and are spaced outwardly therefrom by flexible end flaps secured to the respective display panels.

14 Claims, 5 Drawing Figures

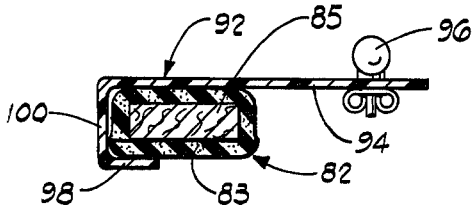
FIG. 3
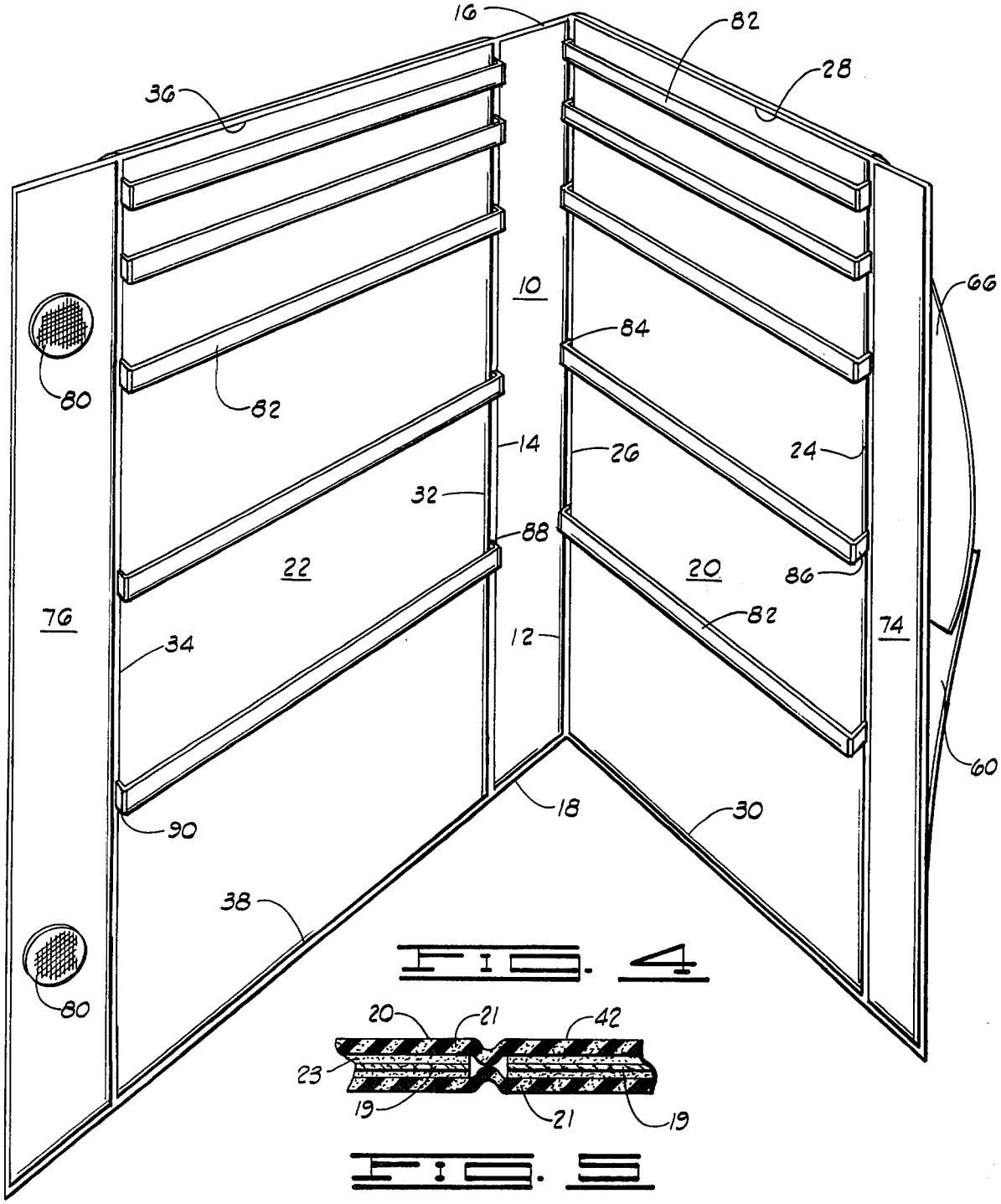
FIG. 4
FIG. 5

EARRING DISPLAY CASE

BACKGROUND OF THE INVENTION

1. Field of the Invention

This invention relates to dual display and storage cases, and more particularly, to jewelry cases which can be quickly and easily closed or opened to a position which can be advantageously employed to display jewelry carried therein.

2. Brief Description of the Prior Art

Various types of display cases or packets which include several folding flaps used to fold and secure the case in a closed position have been heretofore proposed. Some of these have been utilized to contain jewelry or the like. Others have been primarily designed to function as display articles when the case is opened and the flaps are exposed to permit the merchandise carried in the case to be viewed.

One type of display case previously proposed is that shown in Grimsley U.S. Pat. No. 1,863,047. The Grimsley display case or exhibitor includes a plurality of rigid panels which, when folded into one configuration, form parallelepiped having rigid side walls and spaced front and back walls. These walls are oriented at this time to protect certain merchandise in the form of small vials carried on racks which fold to the inside of the exhibitor case in this closed or storage position. In another status of the Grimsley exhibitor, the several panels can be folded back to form a stand which exposes the merchandise to view.

A similar device is disclosed in Lewis U.S. Pat. No. 1,497,519. Various other storage cases are those which are disclosed in Tharp U.S. Pat. No. 2,076,683; Growney U.S. Pat. No. 3,835,987; Shanmas U.S. Pat. No. 3,900,060; Phelps U.S. Pat. No. 3,997,219 and Michal U.S. Pat. No. 4,058,356.

A prior art statement as required by the provisions of 37 C.F.R. 1.56, 1.97 and 1.98 will be submitted concurrently with or shortly following the filing of this application.

BRIEF DESCRIPTION OF THE PRESENT INVENTION

This invention relates to an improved and versatile storage and display case especially adapted for displaying earrings and pendants, and for storing such jewelry. The display case of the invention can be broadly described as including a centrally disposed rectangular back hinge panel which has opposed parallel side edges and opposed parallel end edges. A pair of opposed, substantially rectangular display panels are provided, with each having a side edge hingedly connected to one of the side edges of the back hinge panel, and each having a second side edge. Each of the display panels also has a pair of opposed, parallel end edges which terminate in coplanar alignment with the opposed, parallel end edges of the back hinge panel.

A pair of end hinge panels, each including a first side edge and a second side edge extending parallel to the first side edge, are each hingedly connected along the respective second side edge thereof to an end edge of each of said display panels, so that each of the end edges of each display panel has one of the end hinge panels hingedly connected thereto. Four flexible cover flaps are provided, and each of these has an edge which is connected to the first side edge of one of the end hinge panels, with each end hinge panel thereby having one of the flexible cover flaps hingedly connected thereto.

A pair of locking panels are provided, and each is connected along an edge carried thereby to the second side edge of one of the two display panels. The location of the locking panels is such that they overlap each other when the two display panels are folded upon said back hinge panel to a position in which the display panels extend parallel to each other. A plurality of substantially parallel, spaced clip bars are provided on the interior of the case and extend transversely across each of the display panels. Each of the clip bars is spaced outwardly from the adjacent display panel by flexible end tabs secured to the respective display panel.

The earring display case as thus constructed is flexible in its utilization, and can be folded up to a compact, easily transported status with the jewelry carried on the inner part of the case being well protected by the case in such folded status. Alternatively, the case can be opened out and stood upon one side thereof to permit the jewelry to be viewed while on display.

An important object of the invention is to provide an earring and pendant case which allows earrings and pendants to be quickly and easily clipped to clip bars extending across dual, horizontally spaced display panels within the case, and including structure which assures that the jewelry on one of the display panels does not come in contact with, or abrade, the jewelry on the other display panel at a time when the case is folded to its closed position.

A further object of the invention is to provide an earring and pendant display case which, though it can be quickly and easily folded to a compact storage position with the jewelry safely contained on the interior thereof, can also be quickly and easily opened to a display position, and can stably maintain a self-supporting display position on a flat surface when used for display purposes.

A further object of the invention is to provide a sturdy, economically constructed jewelry display case which is characterized in having a long and trouble-free operating life.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

FIG. 3 is a sectional view taken along line 3—3 of FIG. 2.

FIG. 4 is a perspective view illustrating the appearance of the display case of the invention when it is stood in a self-supporting vertical display position.

FIG. 5 is a sectional view taken along line 5—5 of FIG. 2.

DETAILED DESCRIPTION OF A PREFERRED EMBODIMENT OF THE INVENTION

Figure 1:
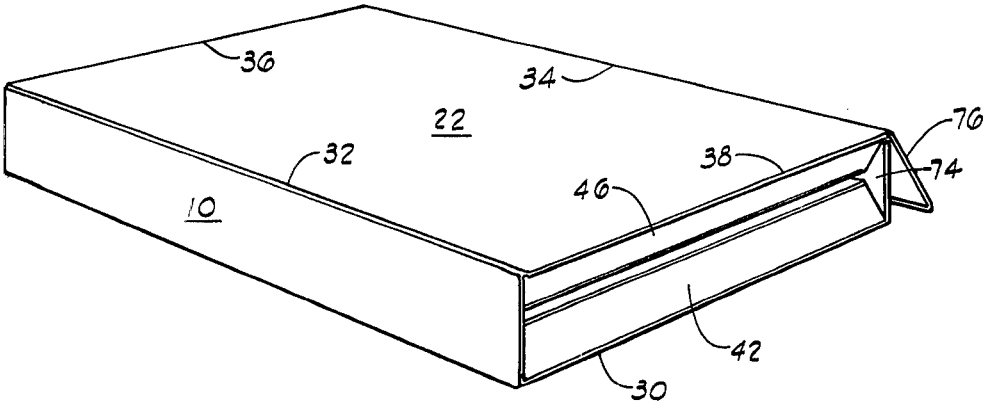
FIG. 1 is a perspective view of the earring and pendant display case of the invention as the case appears when it is folded into a compact, closed storage status.
Figure 2:
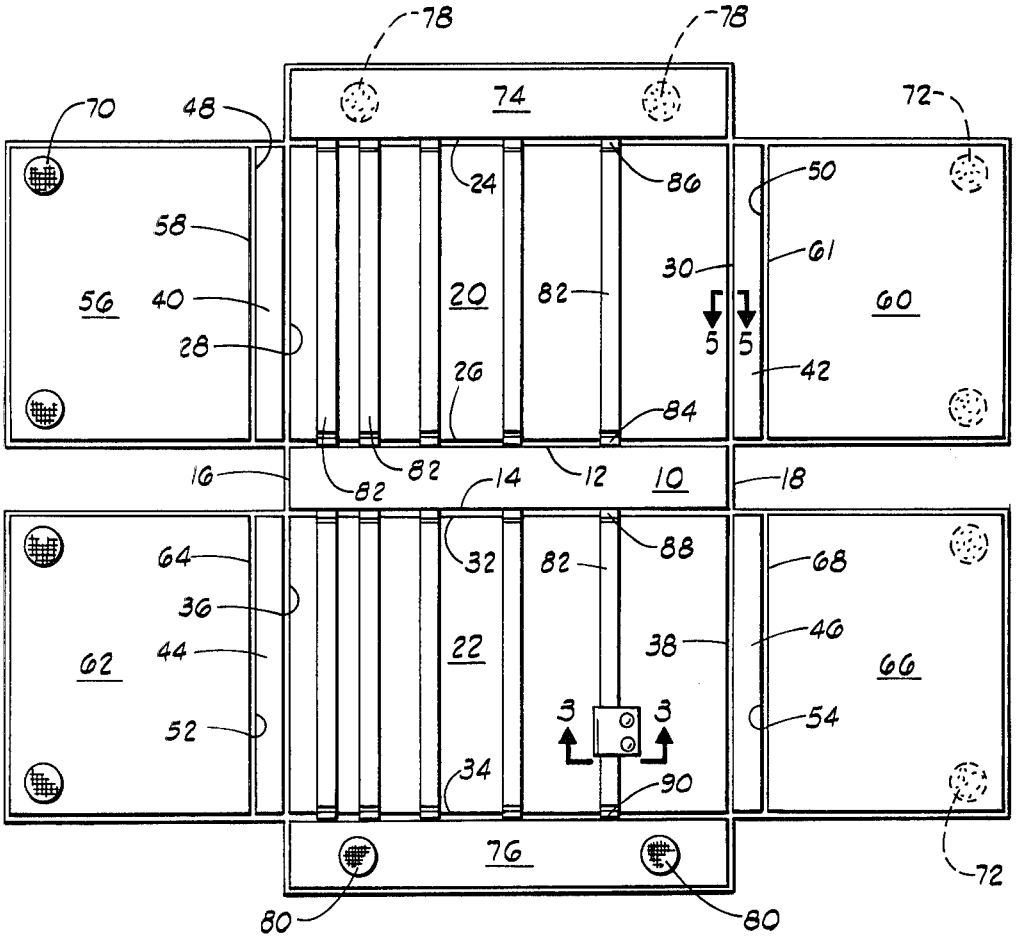
FIG. 2 is a plan view of the jewelry display case folded out to a flat display status and showing the appearance of the interior of the case.

Referring initially to FIGS. 1 and 2 of the drawings, the display case includes a centrally located back hinge panel 10 which is rectangularly configured, and thus includes a pair of opposed, substantially parallel side edges 12 and 14 and a pair of opposed, substantially parallel end edges 16 and 18. The back hinge panel 10 is of relatively rigid construction, and in a preferred embodiment of the invention, includes a stiff cardboard or plastic insert panel 19 which is covered by a soft flexible material 21 such as velvet, velour, suede or the like, or a synthetic resin having a surface finish simulating such fabrics. A thin layer of foam rubber padding 23 is interposed between the panel 19 and the material 21.

A pair of substantially rectangular display panels 20 and 22 are located on opposite sides of the centrally located back hinge panel 10. The display panel 20 has a pair of opposed, substantially parallel side edges 24 and 26 and a pair of opposed, substantially parallel end edges 28 and 30. Similarly, the display panel 22 includes a pair of opposed, substantially parallel end edges 36 and 38 and a pair of opposed, substantially parallel side edges 32 and 34. It will be noted that the end edges 36 and 38 and 28 and 30 of the two display panels 22 and 20, respectively, terminate in alignment with the end edges 16 and 18 of the back hinge panel 10.

Connected to each of the end edges 28, 30, 36 and 38 of the two display panels 20 and 22 is a substantially rectangular end hinge panel. Thus, an end hinge panel 40 is hingedly connected to the end edge 28 of the panel 20 and an end hinge panel 42 is hingedly connected to the end edge 30 of the same display panel. End hinge panels 44 and 46 are hingedly connected to the end edges 36 and 38, respectively, of the display panels 22. Each of the end hinge panels 40–46 is constructed similarly to the display panels 20 and 22 and to the back hinge panel 10, and is thus relatively rigid. This construction is illustrated in FIG. 5 where it will be noted that the opposed layers of cover material 21 are brought together and superimposed to form the hinge between the end hinge panel 42 and the display panel 20. Each of the end hinge panels will also be perceived to have a transverse width as measured between opposed side edges which is substantially equivalent to one-half the transverse width of the back hinge panel 10. The purpose of this construction will hereinafter become apparent.

Each of the end hinge panels 40–46 includes a second longitudinal edge which is opposite that edge connected to the adjacent end edge of one of the display panels. Thus, the end hinge panel 40 includes a longitudinal side edge 48 which extends substantially parallel to its side edge connected to the display panel end edge 28. The end hinge panel 42 includes a longitudinally extending side edge 50 which is projected substantially parallel to the end edge 30 of the display panel 20. In similar fashion, the end hinge panels 44 and 46 include longitudinally extending side edges 52 and 54, respectively.

Flexible cover flaps are joined to the several end hinge panels 40–46 along the longitudinal side edges 48–54, respectively, thereof. Thus, a first flexible cover flap 56 of generally rectangular configuration is hingedly joined along one side edge 58 to the side edge 48 of the end hinge panel 40. A flexible cover flap 60 of generally rectangular configuration is hingedly joined along a side edge 61 to the side edge 50 of the end hinge panel 42. A generally rectangular flexible cover flap 62 is joined along a longitudinal side edge 64 to the side edge 52 of the end hinge panel 44. Finally, a flexible cover flap 66 is joined along its side edge 68 to the side edge 54 of the end hinge panel 46. It should be here noted that the flexible cover flaps 56, 60, 62 and 66 are constructed of a relatively soft material padded internally with a thin layer of foam rubber, which material can be the same velvet, velour or suede-like material used to cover the display panels 20 and 22. The cover flap construction does not include the stiffening cardboard liner or other rigidifying internal panel.

The size of the flexible cover flaps 56, 60, 62 and 66 is such that each of the cover flaps has a transverse width which exceeds one-half the length of each of the display panels 20 and 22. Thus, when the two cover flaps in each cover flap pair are folded toward each other, the two cover flaps will overlap each other over the medial portion of each of the display panels 20 and 22 in a fashion hereinafter described. The flexible cover flaps 56 and 62 each carry one or more fastening tabs 70 which are secured on that portion of the respective flap which will overlap the counterpart cover flap at the opposite end of the respective display panel 20 or 22. In the illustrated embodiment of the invention, the fastening tabs 70 are made of the hook portion of complementary Velcro plates constructed in accordance with principles well understood in the art. As such, the tabs 70 have miniature, relatively rigid hooks which project outwardly and are adapted to engage small eyes carried on cooperating fastener tabs 72 positioned on the flexible cover flaps 60 and 66. The tabs 72 are located so that registration and contact of the tabs 70 with the tabs 72 is assured when the flexible cover flaps are overlapped across the medial portion of the respective display panels 20 and 22.

A pair of locking panels 74 and 76 are disposed at opposite sides of the case, and are connected to the respective side edges 24 and 34 of the display panels 20 and 22. The locking panels 74 and 76 are preferably rectangular in configuration, and are coextensive in length with the display panels 20 and 22. Each of the locking panels 74 and 76 is constructed similarly to the display panels 20 and 22 in having a relatively rigid liner or core of stiff cardboard or synthetic resin with a covering of soft velour, velvet or suede-like material. The locking panel 74 carries fastening tabs 78 of the type hereinbefore described, which tabs are recessed or countersunk into the surface of the locking panel so that their exposed contact surfaces are flush with the surface of the locking panel 74. The locking panel 76 carries complementary, cooperating fastening tabs 80 on the opposite side of the locking panel from the related side of the locking panel 74 upon which the recessed tabs 78 are located. Again, cooperating Velcro tabs are preferably utilized in a manner well understood in the art.

For the purpose of securing within the display case a plurality of jewelry items to be displayed or stored, and more particularly, for securing earrings and pendants in the case, a plurality of clip bars 82 extend transversely across each of the display panels 20 and 22 and are oriented in spaced, parallel relation to each other. It will be noted that the clip bars 82 adjacent one end of each of the display panels 20 and 22 are relatively closer to each other than the clip bars adjacent the other end of the respective display panels. This arrangement enables relatively small earrings to be displayed upon the relatively closely spaced clip bars, and pendants or larger earrings to be supported upon the other, more widely spaced clip bars. Each of the clip bars 82 is preferably constructed by enclosing within a sleeve 83 of velvet, velour or suede-like material, an elongated strip 85 of relatively rigid polypropylene synthetic resin. Other constructions, however, may also be used in lieu of the described preferred structure.

At the opposite ends of each of the clip bars 82, the respective bar is connected to the outer side edges of its respective display panel by means of flexible end tabs. Thus, the clip bars which are mounted on the display panel 20 are connected thereto by the flexible end tabs 84 and 86 which function to space the ends of respective clip bars 84 outwardly slightly from the adjacent surface of the display panel 20. Similar flexible end tabs 88 and 90 connect the opposite ends of each clip bar 82 carried on the display panel 22 to this display panel.

FIG. 3 depicts the manner in which a pair of earrings can be displayed in the display case of the invention. Here, a synthetic resin clip plate, desiganted generally by reference numeral 92, includes an attachment panel 94 to which a pair of earrings 96 are secured. A leg 98 is interconnected to the attachment panel 94 by a web 100. The clip plate 92 frictionally engages the clip bar 82 of the display case by reason of the resiliency of the synthetic resin of which the clip plate is constructed, and the limited spacing between the leg 98 and the attachment panel 94.

In the use of the display case, a plurality of earrings, pendants or the like are displayed by mounting them upon the clip bar using the arrangment illustrated in FIG. 3. As previously explained, the spacing of the clip bars 82 is such that a number of variously sized jewelry items can be aesthetically displayed over the exposed surface of the display panels 20 and 22. Two forms in which the display can be made are illustrated in FIGS. 2 and 4 of the drawings. Thus, the display case may be laid flatly upon a supporting surface, with the flexible cover flaps opened up, along with the locking panels 74 and 76, so that all panels of the display case occupy a common plane. In this position, all of the items of jewelry carried on the clip bars 82 are exposed to view. Alternatively, the flexible cover flaps 56, 60, 62 and 66, as well as the locking panels 74 and 76 and the end hinge panels 40–46, can all be folded up under the display panels 20 and 22, if desired, to give these panels an elevated status in relation to the supporting surface, and thus accentuate the display in the eye of the viewer.

A different manner of display of the jewelry items using the display case of the invention is illustrated in FIG. 4. In this arrangement, the display case is extended substantially vertically with respect to a supporting surface, and the display panels 20 and 22 are angled with respect to each other. Support is provided by both the angulated display panels and also the back turned end hinge panels 42 and 46 (not visible). If desired during this form of display, the flexible cover flaps can be overlapped at the rear side of the display panels 20 and 22 (as shown in FIG. 4), and secured in this overlapped position by interengagement of the tabs 70 with the cooperating tabs 72. Further support for the display panels 20 and 22 can be provided, if desired, by angling the locking panels 74 and 76 with respect to the display panels 20 and 22.

When it is desired to fold the display case into a storage or transport position, the jewelry carried on the clip bars is first protectively covered by extending the flexible cover flaps 56 and 60 into overlapping relation to protect the jewelry carried on the display panel 20, and positioning the cover flaps 62 and 66 in the same fashion to protect the jewelry carried on the display panel 22. The flexible cover flaps are relatively thin in comparison to the thickness of the display panels and the several other relatively rigid panels forming parts of the display case.

After the jewelry has been protectively covered by securement of the flexible cover flaps in overlapped relation across the display panels 20 and 22, the two display panels are then each pivoted about the side edges 12 and 14 of the centrally disposed rectangular back hinge panel 10. Folding about these side edges of the back hinge panle 10 is continued until the display panels 20 and 22 extend substantially parallel to each other, and the overlapped flexible cover flaps 56–60 and 62–66 are disposed inside the case and between the display panels 20 and 22. This status is illustrated in FIG. 1.

When the folding of the display panels in the manner described has been completed, the locking panels 74 and 76 are then folded about the side edges 24 and 34 of the respective display panels 20 and 22 to bring them into overlappped, superimposed position as shown in FIG. 1. At this time, the tabs 78 engage the tabs 80 to secure the display case in a closed storage position. It will be noted that when the display case is in the described status, the end hinge panels 40–46 function to space the display panels 20 and 22 from each other, and thus assure that no contact exists between the items of jewelry carried on each of the display panels, and that, in fact, no substantial crushing pressure is applied to the outer faces of the two display panels which might damage the jewelry carried inside the display case.

Although a preferred embodiment of the invention has been herein described in order to illustrate the principles of the invention, it will be understood that various changes and modifications in the illustrated and described structure can be made therein without departure from such basic principles. Changes and innovations of this type are therefore deemed to be circumscribed by the spirit and scope of the invention, except as the same may be necessarily limited by the appended claims or reasonable equivalents thereof.

What is claimed is:

1. A display case comprising:

a substantially rectangular back hinge panel having opposed, parallel side edges and opposed, parallel end edges;

a pair of opposed, substantially rectangular display panels each having a first side edge hingedly connected to one of the side edges of said back hinge panel, and each further having a second side edge, and opposed, parallel end edges terminating in alignment with the end edges of said back hinge panel;

a pair of end hinge panels each including a first side edge and each having a second side edge, said end hinge panels each being hingedly connected along the second side edge thereof to an end edge of one of said display panels, with two of said end hinge panels being connected to the respective opposite end edges of each of said display panels, said display panels, back hinge panel and end hinge panels each being relatively rigid, and each including:

centrally disposed stiffening core means; and a relatively flexible fabric covering and enclosing said core means;

four flexible cover flaps each having an edge connected to the first side edge of an end hinge panel;

a pair of spaced locking panels hingedly connected to the second side edges of the two display panels, and dimensioned to overlap each other when the display panels are folded upon said back hinge panels to positions in which they extend parallel to each other;

a plurality of substantially parallel, spaced clip bars extending transversely across each of the display panels and spaced outwardly therefrom; and means securing each of the clip bars to one of said display panels and spacing the respective clip bar from the display panel to which it is secured.

2. A display case as defined in claim 1 and further characterized as including cooperating first locking tabs carried on said locking panels for locking said locking panels in an overlapped closure position when said case is closed with said display panels extending parallel to each other and substantially normal to said back hinge panel.

3. A display case as defined in claim 1 and further characterized as including cooperating second locking tabs carried on said flexible cover flaps for securing pairs of said flaps in overlapped relation to each other both at a time when said case is closed with said display panels extending parallel to each other, and at a time when said case is opened with said display panels in coplanar alignment.

4. A display case as defined in claim 1 wherein each of said flexible cover flaps is of rectangular configuration and is dimensioned to extend across and cover more than one-half of an adjacent one of said display panels when the respective cover flap is extended in a plane parallel to said adjacent display panel and spaced therefrom by the width of the end hinge panel to which the respective cover flap is connected whereby said pair of cover flaps located at opposite ends of each display panel can be folded to an overlapping position covering the adjacent one of said display panels.

5. A display case as defined in claim 1 wherein each of said end hinge panels has a width, as measured between said first and second side edges thereof, which is about one-half the width of said back hinge panel, as measured between the opposed, parallel side edges thereof.

6. A display case as defined in claim 1 wherein each of said clip bars extends across substantially the entire width of the display panel and is spaced outwardly therefrom by a distance less than one-half the width of said back hinge panel as measured between the parallel side edges thereof.

7. A display case as defined in claim 1 wherein said means securing each of said clip bars to one of the display panels comprises flexible end tabs connected to opposite ends of each of said clip bars and to the adjacent one of said display panels to which the respective clip bar is secured.

8. A display case as defined in claim 1 wherein each of said locking panels is rectangular in configuration and extends parallel to said back hinge panel and has a width which is substantially equal to said back hinge panel.

9. A display case as defined in claim 2 wherein each of said locking panels is rectangular in configuration and extends parallel to said back hinge panel and has a width which is substantially equal to said back hinge panel.

10. A display case as defined in claim 9 wherein each of said cover flaps is of rectangular configuration, and is dimensioned to extend across and cover more than one-half of an adjacent one of said display panels when the respective cover flap is extended in a plane parallel to said adjacent display panel and spaced therefrom by the width of the end hinge panel to which the respective cover flap is connected whereby said pair of cover flaps located at opposite ends of each display panel can be folded to an overlapping position covering the adjacent one of said display panels.

11. A display case as defined in claim 10 wherein each of said end hinge panels has a width as measured between said first and second side edges thereof, which is about one-half the width of said back hinge panel, as measured between the opposed, parallel side edges thereof.

12. A display case as defined in claim 11 wherein said means securing each of said clip bars to one of the display panels comprises flexible end tabs connected to opposite ends of each of said clip bars and to the adjacent one of said display panels to which the respective clip bar is secured.

13. A display case comprising:

a substantially rectangular back hinge panel having opposed, parallel side edges and opposed, parallel end edges;

a pair of opposed, substantially rectangular display panels each having a first side edge hingedly connected to one of the side edges of the back hinge panel, and each further having a second side edge;

means connected to said end edges of said display panels for covering and separating said display panels when said case is closed;

a pair of spaced locking panels hingedly connected to the second side edge of one of said display panels and each having a size and shape substantially identical to that of said back hinge panel, said back hinge panel, display panels and locking panels being relatively rigid, and each including:

centrally disposed stiffening core means; and a relatively flexible fabric covering and enclosing said core means;

a plurality of substantially parallel, spaced clip bars extending transversely across each of the display panels and spaced outwardly therefrom;

first locking tab means carried on one side of one of said locking panels; and second locking tab means carried on the other of said locking panels and positioned to register with and engage said first locking tab means when said display panels are folded on said back hinge panel to a position in parallelism with each other, and said locking panels are folded on said display panels to a position in which they extend parallel to each other, and perpendicular to said display panels.

14. A display case comprising:

a substantially rectangular back hinge panel having opposed, parallel side edges and opposed, parallel end edges;

a pair of opposed, substantially rectangular display panels each having a first side edge hingedly connected to one of the side edges of said back hinge panel, and each further having a second side edge, and opposed, parallel end edges terminating in alignment with the end edges of said back hinge panel;

a pair of end hinge panels each including a first side edge and each having a second side edge, said end hinge panels each being hingedly connected along the second side edge thereof to an end edge of one of said display panels, with two of said end hinge panels being connected to the respective opposite end edges of each of said display panels, each of said end hinge panels having a width as measured normal to said second side edge which is substantially one-half the width of said back hinge panel;

four flexible cover flaps each having an edge connected to the first side edge of one of the end hinge panels;

a pair of spaced locking panels hingedly connected to the second side edges of the two display panels, and dimensioned to overlap each other when the display panels are folded on said back hinge panel to positions in which they extend parallel to each other, said locking panels each having a width as measured in a direction normal to the respective second side edge of the display panel to which each locking panel is connected which is substantially equal to the width of said back hinge panel;

a plurality of substantially parallel, spaced clip bars extending transversely across each of the display panels and spaced outwardly therefrom by a distance not more than one-half the width of said back hinge panel, and each having ends secured to one of the respective display panels on one side thereof; and locking tabs carried on each of said flexible cover flaps for securing pairs of said flaps in overlapped relation to each other both at the time when said case is closed and with said display panels extending parallel to each other, and also at a time when said case is opened with said display panels in coplanar alignment and said flexible cover flaps folded back against the opposite side of said display panel from the side carrying said clip bars.

* * * * *